US007140972B2

(12) United States Patent
Redwine et al.

(10) Patent No.: US 7,140,972 B2
(45) Date of Patent: Nov. 28, 2006

(54) CHEMILUMINESCENT GOLF BALL

(75) Inventors: Christopher Redwine, Los Angeles, CA (US); Matthew Schoenfeld, Los Angeles, CA (US)

(73) Assignee: Twilight Golf Balls, LLC, San Francisco, CA (US)

( * ) Notice: Subject to any disclaimer, the term of this patent is extended or adjusted under 35 U.S.C. 154(b) by 47 days.

(21) Appl. No.: 09/927,035

(22) Filed: Aug. 9, 2001

(65) Prior Publication Data

US 2003/0176240 A1 Sep. 18, 2003

(51) Int. Cl.
*A63B 69/36* (2006.01)
*A63B 37/00* (2006.01)

(52) U.S. Cl. ..... 473/280; 473/351; 473/570

(58) Field of Classification Search ..... 473/510; 273/DIG. 24
See application file for complete search history.

(56) References Cited

U.S. PATENT DOCUMENTS

| | | | | |
|---|---|---|---|---|
| 2,020,484 | A | 11/1935 | Turner | |
| 4,260,157 | A | 4/1981 | Jones | |
| 4,479,649 | A | 10/1984 | Newcomb | |
| 4,695,055 | A | 9/1987 | Newcomb | |
| 4,878,674 | A | 11/1989 | Newcomb et al. | |
| 4,927,015 | A | 5/1990 | Jones | |
| 4,991,851 | A | 2/1991 | Melesio | |
| 5,007,647 | A | 4/1991 | Gulick | |
| 5,018,450 | A * | 5/1991 | Smith | 102/513 |
| 5,228,697 | A | 7/1993 | Gulick | |
| 5,330,195 | A | 7/1994 | Gulick | |
| 5,445,373 | A | 8/1995 | Franks | |
| 5,490,047 | A | 2/1996 | O'Rourke | |
| 5,562,290 | A * | 10/1996 | Wei | 273/DIG. 24 |
| 5,779,574 | A | 7/1998 | Allman | |
| 5,882,239 | A * | 3/1999 | Trichak | 446/219 |
| 6,042,487 | A | 3/2000 | Schrimmer | |
| 6,257,995 | B1 | 7/2001 | Schrimmer | |
| 6,543,365 | B1 * | 4/2003 | Vasel et al. | 102/502 |
| 2003/0236136 | A1 * | 12/2003 | Dijkgraaf et al. | 473/351 |

FOREIGN PATENT DOCUMENTS

| | | | |
|---|---|---|---|
| FR | 2832318 | A1 * | 5/2003 |
| JP | 60222071 | A * | 11/1985 |

* cited by examiner

*Primary Examiner*—Eugene Kim
*Assistant Examiner*—Alvin A. Hunter, Jr.

(57) ABSTRACT

An illuminated golf ball comprised of an outer translucent layer and cover, and a spherical inner core of translucent plastic, filled with chemiluminescent liquid, such as Cyalume.TM. The two components of the chemiluminescent liquid are held separate by a membrane or partition within the inner core. The chemiluminescent liquids are activated by being mixed with each other by the pulling of a cord, or the pulling or pushing of metal pin, or by impact from a golf club, which breaks or tears the membrane or partition. In a preferred form the golf ball will be made to comply with USGA guidelines. Thus, the golf ball will provide improved visibility in low light conditions and be of near equal weight distribution to provide performance and flight characteristics similar to standard, non-luminescent, golf balls.

1 Claim, 2 Drawing Sheets

CHEMILUMINESCENT GOLF BALL

CROSS REFERENCE TO RELATED APPLICATIONS

Not applicable

FEDERALLY SPONSORED RESEARCH OR DEVELOPMENT

Figure 1:
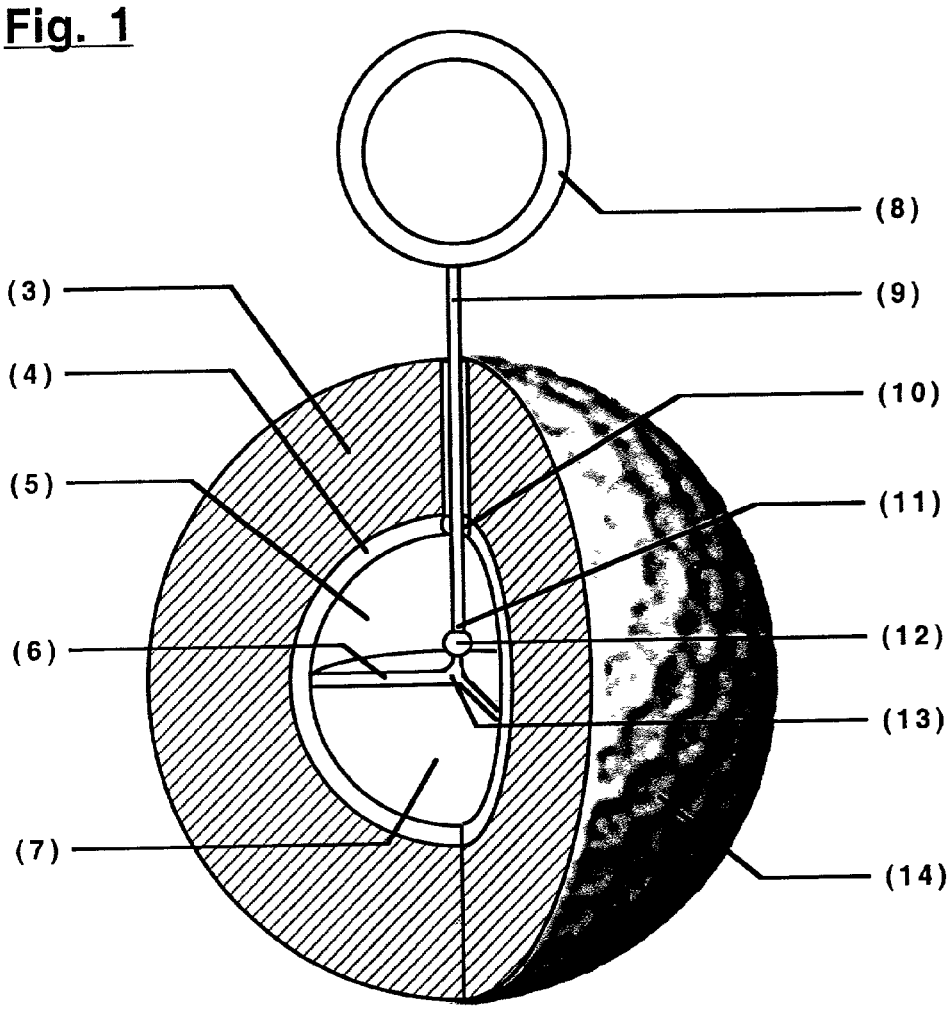

This invention is not in any way involved with Federally sponsored research or development.

FIELD OF INVENTION

This invention pertains to a luminescent or illuminated golf balls, having a self contained lighting device, for evening and nighttime use, and to be made more visible in low light conditions.

BACKGROUND OF INVENTION AND PRIOR ART

As any golfer knows, it is typical for golf courses to remain open and for play to continue as long as there is sufficient daylight. Most courses also have special rates for twilight play, as it is understood that the golfer must try to finish a round as daylight is running out, and may not be able to finish at all as it can become too dark to play before the round can be finished. Under such conditions, a golf ball, which is slightly more than one and one half inches across, can be very difficult to see at a distance and the possibility of losing a ball in the course of play is greatly increased.

Prior art attempts to overcome this problem have included several variations, making use of different light sources, such as electric lighting elements, lightsticks, as well as attempts in which photostorage material is mixed into the ball's cover material.

In the case of prior art making use of electric lighting elements, such as disclosed in U.S. Pat. No. 6,257,995, complex electrical circuits and switches, as well as batteries and LEDs are enclosed within the ball's core, inside an outer translucent shell. Such electrical elements create the problem of uneven weight distribution, which can affect the flight properties of the ball, as well as affecting the compression characteristics when hit with a golf club. Another problem is the fragile nature of electrical circuits, batteries and lighting elements, which when hit by the severe impact of a golf club, can be rendered inoperable.

Other prior art, such as disclosed in U.S. Pat. No. 4,878,674, includes the use of separate, cylindrical lightsticks, which are activated, then inserted through a hole drilled through the core of a translucent golf ball. This example of prior art would seem to provide adequate light for its purpose. However, due to the cylindrical shape of the lightsticks, weight distribution is necessarily uneven, and performance of these golf balls is severely impaired, traveling slightly more than half the distance of a standard, non-luminescent, golf ball hit with the same club. Another problem presented by this prior art is that a separate lighting element is utilized, first activated, then inserted into the ball. Thus, the lighting element is not a self contained structural component of the ball itself, which diminishes distance and flight characteristics.

Another example of prior art makes use of photostorage materials, mixed into the cover, and outer layer materials, such as disclosed in U.S. Pat. No. 5,330,195. This prior art is able to create a ball which is of standard size and weight, with performance characteristics similar to standard golf balls. However, the energy required to power the photostorage material is not contained within the ball, requiring the use of a flashlight or similar device to first charge the photostorage material before use. Thus the light source utilized is not self powered.

Thus, there remains a need for a luminescent golf ball with a self-contained and self-powered lighting device to be made more visible in low light conditions, which complies with the United States Golf Association ("USGA") rules and regulations for golf ball size and weight, and having with general performance characteristics similar to standard, non-luminescent, golf balls.

SUMMARY OF INVENTION

The present invention utilizes a chemiluminescent liquid mixture, such as Cyalume.TM, contained within a spherical inner core of a golf ball, enclosed within outer translucent layers of materials common to standard, non-luminescent, golf ball construction. A means of activation is also provided such that the chemiluminescent liquid mixture can be activated when ready for use, and will provide adequate light to be seen at a distance in low light conditions for a matter of hours, allowing for continued play in twilight or at night.

OBJECTS AND ADVANTAGES

Accordingly, besides the objects and advantages of the chemiluminescent golf ball described above, other objects and advantages of the present invention are:

a) to provide a golf ball which has a self-contained and self-powered light source, providing greater visibility in low light conditions, making it easier for golfers to find their ball, and to continue play in such conditions;

b) to incorporate a light source without necessity of outside charging devices or separate components;

c) to incorporate the lighting source itself as a structural component inside a solid golf ball, in the shape of a sphere, providing for substantially even weight distribution, and thereby providing performance characteristics similar to standard, non-luminescent, golf balls;

d) to provide a golf ball which conforms to standard golf ball size, weight, and performance requirements as set by the USGA, and/or other golf organizations worldwide.

Further, objects and advantages will become apparent from a consideration of the ensuing description and drawings.

DRAWING FIGURES

FIG. 1 shows a cut-away view of an example of the preferred embodiment, utilizing a pull cord connected to a separating membrane as a means of activation and a ball plug and socket as a sealing mechanism.

Figure 2A:
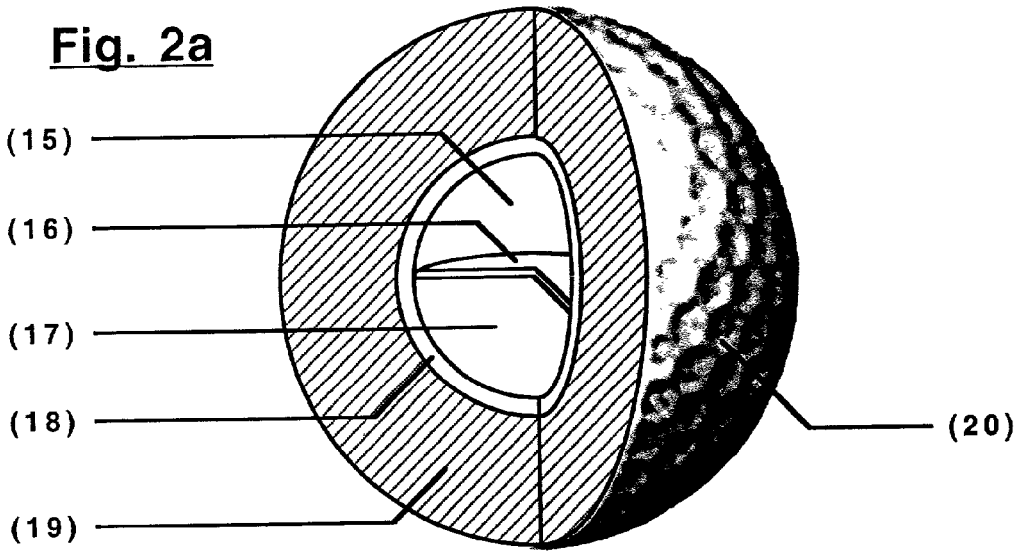
Figure 2B:
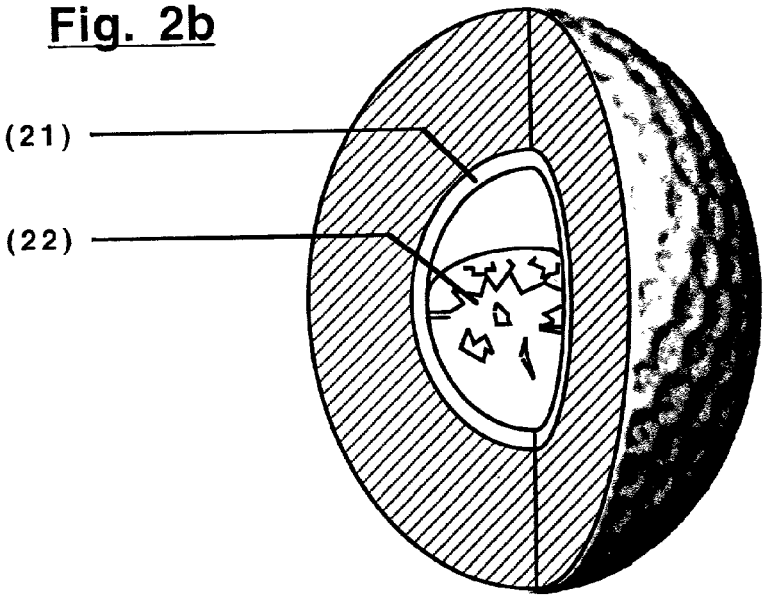

FIGS. 2*a* and 2*b* shows a cut-away view of an example of an additional embodiment in which the means of activation is by impact as from a golf club. FIG. 2*a* shows the ball before use, and FIG. 2*b* shows the ball under compression of impact.

| REFERENCE NUMERALS IN DRAWINGS | |
|---|---|
| 3 | Outer translucent later(s) |
| 4 | inner core shell |
| 5 | chemiluminescent component 1 |
| 6 | membrane or partition |
| 7 | chemiluminescent component 2 |
| 8 | pull cord ring |
| 9 | pull cord |
| 10 | ball socket |
| 11 | cord weak point |
| 12 | ball plug |
| 13 | membrane to pull cord connection |
| 14 | dimpled surface |
| 15 | chemiluminescent component 1 |
| 16 | breakable membrane or partition |
| 17 | chemiluminescent component 2 |
| 18 | inner core shell |
| 19 | outer translucent layer(s) |
| 20 | dimpled surface |
| 21 | inner core shell |
| 22 | broken membrane or partition |

DESCRIPTION-FIG. 1—PREFERRED EMBODIMENT

A preferred embodiment of the golf ball of the present invention is illustrated in FIG. 1 (cut-away view). The golf ball is comprised of an outer layer or layers (3) of translucent polymers or other materials commonly used in standard golf ball construction such as Surlyn.TM, which allows for the transmission of light. The outer layers enclose an inner core shell (4) also of translucent polymer material, filled with two components of a chemiluminescent liquid mixture (5 and 7), held separate by a membrane or partition (6) within the inner core shell. Activation of the chemiluminescent liquid mixture is achieved when ready for use by breaking of the membrane (10), thereby mixing the two components (5 and 7) together. The membrane is broken by pulling on a cord (9) made of wire, or polymer material, attached to the membrane (13), and extending out through a hole in the shell of the inner core and outer layers and cover of the golf ball. Pressure is applied by pulling on the cord ring (8), the force of which tears the membrane (6), mixing the components (5 and 7) of the chemiluminescent liquid mixture, and thus activating its luminescent property. As more pressure is applied by pulling on the cord ring (8), a plug or ball (12) is pulled into a seat or socket (10) in the shell of the inner core, thereby sealing in the chemiluminescent liquid mixture. As still more pressure is applied, the cord is made to break above the ball or plug at a weak point (11) and be removed completely, leaving the components mixed, the inner core sealed, the cord removed from the ball, and light from the chemiluminescent liquid mixture visible through the translucent outer layers (3). The outer surface (14) is also dimpled for better ball performance in the course of play.

DESCRIPTION-FIGS. 2A AND 2B—ADDITIONAL EMBODIMENTS

An example of an additional embodiment is shown in FIGS. 2*a* and 2*b*, in which the components (15 and 17) of the chemiluminescent liquid mixture are held separate by a membrane or partition (16) of brittle plastic or glass. The components are caused to mix by breakage of the membrane (22) as caused by compression under severe impact as by a golf club (FIG. 2*b*). As in the previous example in FIG. 1, the outer layer (19) and innerc ore shell (18 and 21) are also of translucent polymer material and the outer surface (20) is dimpled.

ALTERNATIVE EMBODIMENTS

There are various possibilities with regard to the means of activation by mixing of the components of the chemiluminescent liquid mixture. Examples include the pushing or pulling of a metal or plastic pin, releasing a valve inside the inner core, as well as various shapes and designs for the separating membrane or partition and sealing mechanisms, including an inner core that remains sealed without a need for any sealing mechanism. There are also various possibilities for the shape and design of the breakable membrane or partition such as illustrated in FIGS. 2*a* and 2*b* so as to affect the fluid dynamics of the liquid mixture as may affect spin rate, and thus characteristics, and ball performance. Another area in which there is nearly endless possibility for design variation is in dimple design which also may be used to alter flight characteristics. There is also the possibility of a design in which the inner core shell comprises the bulk of the outer layers and/or cover, such that the outer translucent layer itself comprises the inner core shell.

In any preferred embodiment it is also preferable that the materials used for the separating mechanism be of a similar weight per cubic volume to the chemiluminescent liquid mixture so as not to disrupt the weight distribution of the entire inner core.

OPERATION

The manner of using the present invention is by the means of activation by either pulling a cord (8, and 9), pushing or pulling a pin, or by striking the ball with a club, so as to affect the membrane or partition (6, 16, and 22) so as to mix the components and create the active chemiluminescent liquid mixture. When activated, the golf ball of this invention is luminescent and more clearly visible to the eye in low light conditions, as well as having variable properties of spin, distance, and flight characteristics similar to standard golf balls.

CONCLUSION AND RAMIFICATIONS

Accordingly, the reader will see that the luminescent golf ball of this invention can be of great use to golfers seeking to finish a round at twilight, play at night, or in other low light conditions as their ball would be made more visible and less susceptible to being lost due to darkness or shadows. The present invention also allows for storage for long periods of time prior to use, and can be activated easily and quickly to be made ready for use. Also, because of substantially even weight distribution of the self contained lighting source, the present invention can be made to perform similarly to standard, non-luminescent golf balls, thus, and not sacrificing ball performance.

Although the description above contains many specificities, these should not be construed as limiting the scope of the invention, but merely providing illustrations of some of the presently preferred embodiments of this invention. For example the separating membrane or partition with the inner core keeping the liquids separate until ready for use can have a variety of different shapes and be positioned in a number of different ways. Also, the mechanism by which the liquids are mixed can be a spring-loaded valve, or a slide which is pushed to create a hole in the partition, as well as various shapes of partition and chambers which are breakable under the compression of impact with a golf club.

Thus, the scope of the invention should be determined by the appended claims and their legal equivalents, rather than by the examples given.

We claim:

1. A spherical, luminescent golf ball comprising:

a spherical outer layer of a translucent polymer material, allowing for transmission and diffusion of light, said spherical outer layer having a first spherical center;

a substantially inner chamber comprising a first hemisphere having a first liquid compound, a second hemisphere having a second liquid compound, and a planar circular portioning element configured to border said first hemisphere and said second hemisphere;

said planar circular partitioning element separating said first hemisphere and said second hemisphere, said planar circular partitioning element configured to rupture when sufficient external force is applied to said golf ball, thereby allowing said first liquid compound and said second liquid compound to mix and form a chemiluminescent liquid mixture that produces light energy;

a cord coupled to the planar circular partitioning element, said cord configured to provide said sufficient external force to said ball by mechanically displacing and rupturing said planar circular portioning element; and said substantially inner chamber having a second spherical center that coincides with the first spherical center of the spherical outer layer, which is configured to provide substantially even weight distribution through said ball.

* * * * *